US006174663B1

(12) United States Patent
Kato

(10) Patent No.: US 6,174,663 B1
(45) Date of Patent: Jan. 16, 2001

(54) HEAT-DEVELOPABLE IMAGE-RECORDING MATERIAL

(75) Inventor: Kazunobu Kato, Minami-ashigara (JP)

(73) Assignee: Fuji Photo Film Co., Ltd., Kanagawa (JP)

( * ) Notice: Under 35 U.S.C. 154(b), the term of this patent shall be extended for 0 days.

(21) Appl. No.: 09/409,666

(22) Filed: Sep. 30, 1999

(30) Foreign Application Priority Data

Sep. 30, 1998 (JP) ..... 10-292869

(51) Int. Cl.[7] ..... G03C 1/498
(52) U.S. Cl. ..... 430/619; 430/610; 430/613
(58) Field of Search ..... 430/610, 619, 430/613

(56) References Cited

U.S. PATENT DOCUMENTS

| | | | | |
|---|---|---|---|---|
| 4,749,645 | * | 6/1988 | Goddard et al. | 430/552 |
| 5,464,738 | | 11/1995 | Lynch et al. . | |
| 5,545,505 | | 8/1996 | Simpson . | |
| 5,545,507 | | 8/1996 | Simpson et al. . | |
| 5,637,449 | | 6/1997 | Harring et al. . | |
| 5,869,229 | * | 2/1999 | Okada et al. | 430/619 |

* cited by examiner

*Primary Examiner*—Thorl Chea

(74) *Attorney, Agent, or Firm*—Birch, Stewart, Kolasch & Birch, LLP

(57) ABSTRACT

A heat-developable image-recording material comprising an organic silver salt, a reducing agent, and an organic binder, wherein the material further comprises a compound represented by the following formula (I) or (II):

(I)

(II)

wherein $R^1$ is a group selected from the group consisting of hydrogen atom, an alkyl group, an aryl group, hydroxyl group, amino group, thiol group, an alkoxyl group, and thioether group; and $R^2$ and $R^3$ may be the same or different and represent hydrogen atom or 1 to 4 functional groups.

14 Claims, No Drawings

HEAT-DEVELOPABLE IMAGE-RECORDING MATERIAL

FIELD OF THE INVENTION

The present invention relates to a so-called heat-developable image-recording material, in which an image is developed by heating without using a developer solution.

BACKGROUND OF THE INVENTION

Heat-developable image-recording materials that can produce images by using the heat development process have been known, and disclosed in, for example, U.S. Pat. Nos. 3,152,904, 3,457,075, and "Imaging Processes and Materials", Neblette's 8th edition, pp.279–291 (1969). The image-recording materials disclosed in the aforementioned literature comprise a silver source which can be reduced (for example, organic silver salt), a catalytically active amount of photocatalyst (for example, silver halide), a color-tone adjustor for controlling tonality of silver, and a reducing agent, which are dispersed in a binder. Such heat-developable image-recording materials are stable at an ambient temperature, but they form blackened silver through oxidation-reduction reaction of the reducible silver salt and the reducing agent when they are heated to an elevated temperature (e.g., 120° C.) after light exposure. This reaction is promoted by catalytic action of latent image generated by the light exposure.

As another image-forming scheme, when the materials do not contain the catalytic amount of silver halide, blackened images can also be obtained by imagewise tracing at an elevated temperature on the materials with a thermal head.

Such image-formation methods require no processing solution such as a developer, and provide images only by heating. The methods do not generate sulfite gas, ammonia gas and the like, and therefore, the materials have been focused as recording materials used in image-forming apparatuses utilizing laser rays. Laser image-forming apparatuses have been used in various fields such as image-forming apparatuses for medical use, photomechanical reproduction, and other industrial use.

These heat-developable recording materials generally require heating at a temperature of 110° C. or higher for 10 seconds to 60 seconds. Output speeds have become faster with the progress of laser image-forming apparatuses, and it has been desired to improve sensitivity and developing speed of the recording materials. In recent years, especially as heat-developable recording materials for photomechanical reproduction, materials utilizing infectious development with an ultrahigh contrast agent have been developed. However, since the infectious development requires prolonged heating time, it has been desired to realize more faster developing speed. Since fog is generally enhanced when the development temperature is elevated to obtain a faster developing speed, an increase of the developing temperature is limited. Therefore, there has been desired a heat-developable recording material that can be developed at a high developing speed within a temperature range that does not enhance the fog.

As conventional high contrast agents for producing high contrast images, there have been disclosed, for example, acylhydrazine derivatives (U.S. Pat. Nos. 5,464,738, 5,512,411, 5,496,695, and 5,536,622), acrylonitrile derivatives (U.S. Pat. Nos. 5,545,516 and 5,635,339), malondialdehydes (U.S. Pat. No. 5,654,130), isoxazoles (U.S. Pat. No. 5,705,324) and the like. As method for accelerating development processes, uses of amine compounds (U.S. Pat. No. 5,545,505), hydroxamic acids (U.S. Pat. No. 5,545,507), hydrogen donors (U.S. Pat. No. 5,637,449) and the like are disclosed.

However, they are still insufficient to achieve a desired high developing speed, and a further effective means has been desired.

SUMMARY OF THE INVENTION

The object of the present invention is to provide an improved heat-developable image-recording material. More specifically, the object of the present invention is to provide a heat-developable image-recording material that enables rapid development.

The aforementioned object was achieved by the present invention, and the present invention thus provides a heat-developable image-recording material comprising an organic silver salt, a reducing agent, and an organic binder, wherein the material further comprises a compound represented by the following formula (I) or (II):

(I)

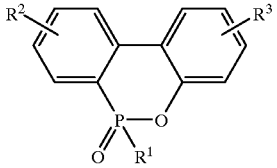

(II)

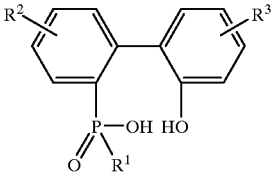

wherein, $R^1$ is a group selected from hydrogen atom, an alkyl group, an aryl group, hydroxyl group, amino group, thiol group, an alkoxyl group, and thioether group.

$R^2$ and $R^3$ may be the same or different and represent hydrogen atom or 1 to 4 functional groups.

According to a preferred embodiment of the aforementioned heat-developable image-recording material of the present invention, the material further contains a photosensitive silver halide grains.

According to another preferred embodiment of the aforementioned heat-developable image-recording material of the present invention, the material further contains a high contrast agent.

PREFERRED EMBODIMENT OF THE INVENTION

The heat-developable image-recording material of the present invention contains an organic silver salt, a reducing agent, and an organic binder, and is characterized to further contain a compound represented by the following formula (I) or (II).

(I)

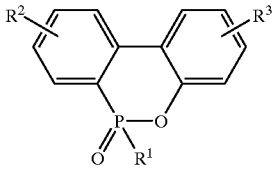

(II)

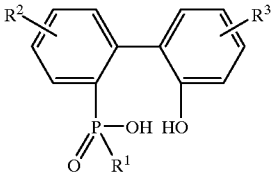

In the formulas, $R^1$ is a group selected from hydrogen atom, an alkyl group, an aryl group, hydroxyl group, amino group, thiol group, an alkoxyl group, and thioether group.

$R^2$ and $R^3$ may be the same or different and represent hydrogen atom or 1 to 4 functional groups.

The alkyl group represented by $R^1$ is preferably an unsubstituted or substituted alkyl group having 1 to 30 carbon atoms. The substituent of the alkyl group may preferably be selected from hydroxyl group, an aryl group which may be substituted, an amino group which may be substituted, carbonyl group, carbamoyl group, thiol group, an alkoxyl group, thioether group and a group composed of a repeating unit of ethyleneoxy or propyleneoxy group. The aryl group which may be substituted is preferably a phenyl group substituted with 1 to 3 hydroxyl groups or amino groups.

Particularly preferred examples of the alkyl group represented by $R^1$ include an alkyl group substituted with one or more hydroxyl groups, an alkyl group substituted with one or more phenyl groups having 1 to 3 hydroxyl groups or amino groups, and an alkyl group having a repeating unit of ethyleneoxy or propyleneoxy group.

The aryl group represented by $R^1$ is preferably an unsubstituted or substituted phenyl group or naphthyl group. The substituent of the aryl group may preferably be selected from hydroxyl group, an amino group which may be substituted, an alkyl group having 1 to 30 carbon atoms, carbonyl group, carbamoyl group, thiol group, an alkoxyl group, thioether group, and a group composed of a repeating unit of ethyleneoxy or propyleneoxy group. Preferred example of the aryl group represented by $R^1$ include a phenyl group substituted with one or more hydroxyl groups or amino groups.

Particularly preferred examples of $R^1$ include hydrogen atom, an alkyl group substituted with one or more hydroxyl groups, and a phenyl group substituted with one or more hydroxyl groups.

$R^2$ and $R^3$ each represent hydrogen atom or a functional group that is substitutable at any position of the benzene ring. The functional group may be selected from various functional groups. Preferably, the functional group may be selected from hydroxyl group, an amino group which may be substituted, an alkyl group having 1 to 30 carbon atoms, carbonyl group, carbamoyl group, thiol group, an alkoxyl group, thioether group, and a group composed of a repeating unit of ethyleneoxy or propyleneoxy group, carboxyl group, cyano group, and phenyl group. Preferably, $R^2$ and $R^3$ are independently hydrogen atom or an alkyl group having 1 to 30 carbon atoms.

These compounds may be added to an image-forming layer containing an organic silver salt or other layers (a protective layer, an intermediate layer, an anti-halation layer, an undercoat layer and the like).

These compounds are dissolved in water or an organic solvent such as methanol, ethanol, acetone, DMF, and ethyl acetate before the addition. They may also be added as an emulsified dispersion or a solid dispersion.

An amount of these compounds may generally be from $1\times10^{-6}$ to $1\times10^{-2}$ mole, preferably from $5\times10^{-6}$ to $5\times10^{-3}$ mole, more preferably from $1\times10^{-5}$ to $1\times10^{-3}$ mole, per mole of silver.

As shown in the following formula, the structures of the compounds of formulas (I) and (II) of the present invention are converted to each other by the addition or elimination of water molecule. Specific examples of the compounds will be described below according to formula (I), however, it should be understood that they may also exist as compounds according to formula (II). In addition, these compounds are described only for illustration, and the scope of the present invention is not limited to these specific compounds.

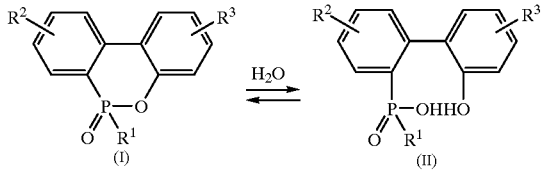

I-1

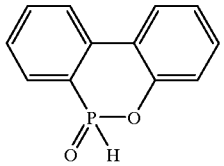

I-2

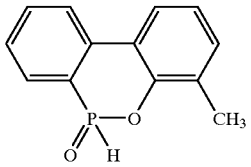

I-3

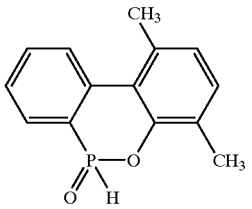

I-4

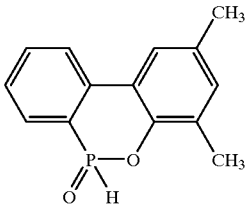

-continued
I-5
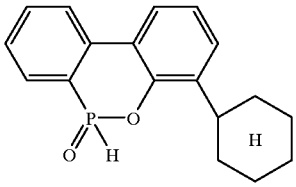
I-6
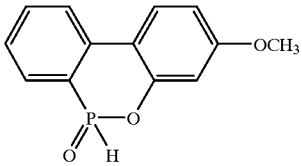
I-7
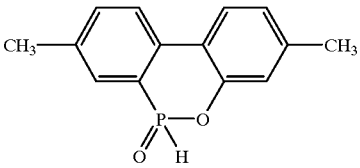
I-8
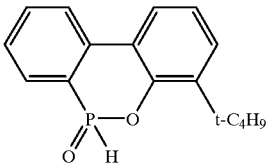
I-9
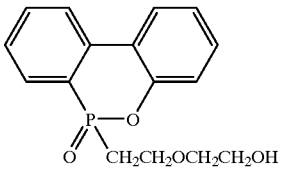
I-10
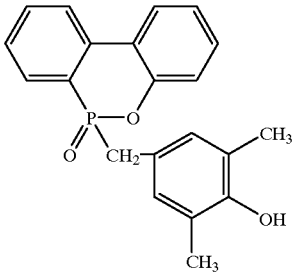
I-11
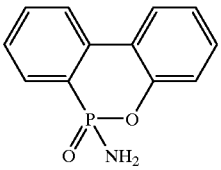
-continued
I-12
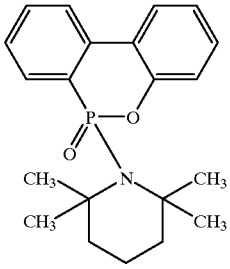
I-13
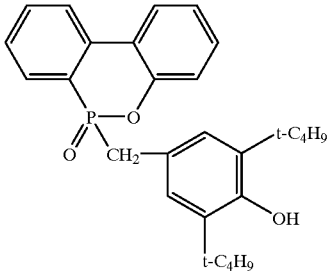
I-14
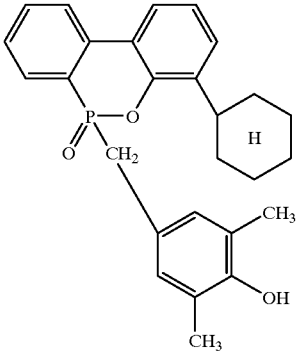
I-15
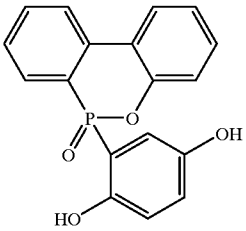
I-16
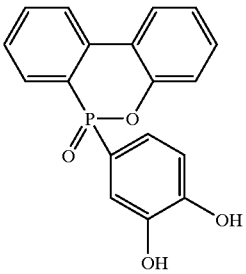

-continued

I-17

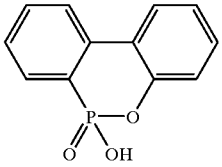

I-18

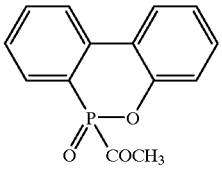

I-19

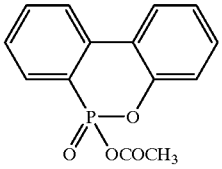

I-20

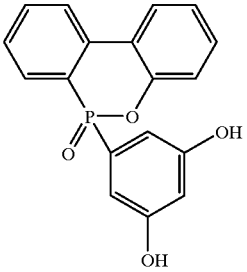

I-21

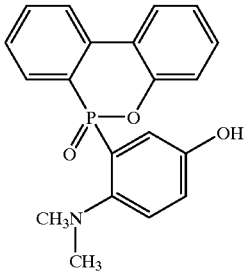

I-22

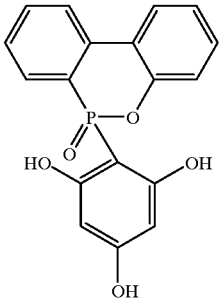

The heat-developable image-recording material of the present invention provides a photographic image by a heat development process. As mentioned above, some heat-developable image-recording materials are disclosed in U.S. Pat. Nos. 3,152,904 and 3,457,075, and D. Morgan and B. Shely, "Thermally Processed Silver Systems", Imaging Processes and Materials, Neblette, 8th ed., Sturge, V. Walworth, A. Shepp, p.2, 1969.

The heat-developable image-recording materials of the present invention may be in any form so long as they can form a photographic image through a heat development process. They may preferably be a heat-developable image-recording material comprising a reducible silver source (i.e., organic silver salt), a catalytically active amount of photocatalyst (e.g., silver halide), a color-tone adjustor for controlling tonality of silver, a high contrast agent, and a reducing agent, which are usually dispersed in a binder matrix. The heat-developable image-recording material of the present invention is stable at an ordinary temperature, and the material is developed after light exposure by heating at an elevated temperature (e.g., 60° C. or higher, preferably 80° C. or higher, and also preferably 120° C. or lower) without a contact of a processing solution. Upon heating, the reducible silver source (which acts as an oxidizer) and the reducing agent produce silver through oxidation-reduction reaction. The oxidation-reduction reaction is accelerated by the catalytic action of latent image produced by light exposure. The silver produced by the reaction of the organic silver salt in the light-exposed area provides a black image, which forms an image in contrast to unexposed areas.

The heat-developable image-recording material of the present invention preferably comprises at least one photosensitive layer on a support. The photosensitive layer may be formed alone on a support, however, at least one light-insensitive layer may preferable be provided on the photosensitive layer.

In order to control the intensity and wavelength distribution of light transmitted to the photosensitive layer, a filter layer may be formed on the same or opposite side of the photosensitive layer on the support. A dye or pigment may be added in the photosensitive layer. Compounds disclosed in the Japanese Patent Application No. 7-11184 may be preferred as the dye.

The photosensitive layer may be formed as a multi-layer form. In that case, the photosensitive layer may be formed to have high sensitivity/low sensitivity layers or low sensitivity/high sensitivity layers to control gradation.

Various additives may be added in the photosensitive layer, light-insensitive layer, or other constituting layers.

The heat-developable image-recording material of the present invention may comprises, for example, surface active agent, antioxidant, stabilizer, plasticizer, ultraviolet absorber, coating aid and the like.

Addition of a color-tone adjustor is highly desirable. Preferable color-tone adjustors are disclosed in Research Disclosure No. 17029, and examples include imides such as phthalimide; cyclic imides, pyrazolin-5-ones and quinazolines such as succinimide, 3-phenyl-2-pyrazolin-5-one, 1-phenylurazole, quinazoline, and 2,4-thiazolidinedione; naphthalimides such as N-hydroxy-1,8-naphthalimide; cobalt complexes such as cobalt hexaminetrifluoroacetate; mercaptans such as 3-mercapto-1,2,4-triazole; N-(aminomethyl)aryldicarboxyimides such as N-(dimethylaminomethyl)phthalimide; combinations of a blocked pyrazole, isothiuronium derivative, and a certain photobleaching agent such as a combination of N,N'-hexamethylene(1-carbamoyl-3,5-dimethylpyrazole), 1,8-(3,6-dioxaoctane)-bis(iso-thiuroniumtrifluoroacetate), and 2-(tribromomethylsulfonyl)benzothiazole); merocyanine dyes such as 3-ethyl-5-((3-ethyl-2-benzothiazolinylidene)-1-methyl-ethylidene)-2-thio-2,4-oxazolidinedione; phthalazinone, phthalazinone derivatives and metals salts of such derivatives such as 4-(1-naphthyl)phthalazinone, 6-chlorophthalazinone, 5,7-dimethyloxyphthalazinone, and 2,3-dihydro-1,4-phthalazinedione; combinations of phthalazinone with a sulfinic acid derivative such as 6-chlorophthalazinone plus sodium benzenesulfinate, and 8-methylphthalazinone plus sodium p-trisulfonate; combinations of phthalazine and phthalic acid; combinations of phthalazine (including phthalazine addition products) with at least one compound selected from maleic anhydride, phthalic acid, 2,3-naphthalenedicarboxylic acid or o-phenylenic acid derivative and anhydrides thereof (e.g., phthalic acid, 4-methylphthalic acid, 4-nitrophthalic acid, and tetrachlorophthalic anhydride); quinazolinediones, benzoxadine, orthoxazine derivatives; benzoxadine-2,4-diones such as 1,3-benzoxadine-2,4-dione; pyrimidines and asymmetric triazines such as 2,4-dihydroxypyrimidine, and tetraazapentalene derivatives such as 3,6-dimercapto-1,4-diphenyl-1H,4H-2,3a,5,6a-tetraazapentalene.

Preferred color-tone adjustors are phthalazines.

The silver halide useful as the photocatalyst used in a catalytic amount may be any photosensitive silver halides such as silver bromide, silver iodide, silver chloride, silver chlorobromide, silver iodobromide, and silver chloroiodobromide, and preferably, contain an iodide ion. The silver halide may be added to the image-forming layer by any method, and the silver halide is provided close to the reducible silver source. In general, the silver halide is contained in an amount of 0.75 to 30% by weight based on the reducible silver source. The silver halide may be prepared by conversion of a silver soap moiety by reaction with a halide ion, or preformed and added during generation of the soap. A combination of these techniques is also possible and may be preferred.

The organic silver salt of the present invention will be explained. As the reducible silver source, silver salts of an organic or heteroorganic acids containing a reducible silver ion source, particularly long-chain (10 to 30, preferably 15 to 25 carbon atoms) aliphatic carboxylic acids, are preferred. Organic or inorganic silver salt complexes having a total ligand stability constant of from 4.0 to 10.0 based on silver ion are also useful. Preferred examples of silver salts are described in Research Disclosure Nos. 17029 and 29963. Specific examples of these silver salts include salts of organic acids (e.g., gallic acid, oxalic acid, behenic acid, stearic acid, palmitic acid, lauric acid); silver salts of carboxyalkylthioureas (e.g., 1-(3-carboxypropyl)thiourea, 1-(3-carboxypropyl)-3,3-dimethylthiourea); silver complexes of polymerization product of aldehydes (e.g., formaldehyde, acetaldehyde, butylaldehyde) with hydroxyl-substituted aromatic carboxylic acid; hydroxyl-substituted acids (e.g., salicylic acid, benzoic acid, 3,5-dihydroxybenzoic acid, 5,5-thiodisalicylic acid); silver salts or complexes of thioenes (e.g., 3-(2-carboxyethyl)-4-hydroxymethyl-4-thiazoline-2-thioene, 3-carboxymethyl-4-thiazoline-2-thioene); silver complexes or salts of nitrogenic acid selected from the group consisting of imidazole, pyrazole, urazole, 1,2,4-thiazole, 1H-tetrazole, 3-amino-5-benzylthio-1,2,4-triazole and benzotriazole; silver salts of saccharin, 5-chlorosalicylaldoxim and the like; and silver salts of mercaptides. A preferred silver source is silver behenate. The reducible silver source is preferably used in an amount of not more than 3 $g/m^2$, more preferably not more than 2 $g/m^2$ as the weight of silver.

The reducing agent used for the present invention will be explained. For heat-developable image-recording materials using organic silver salts, a wide variety of reducing agents have been known. Examples of the reducing agents include, for example, amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl) hydroxylamine, piperidinohexosereductone or formyl-4-methylphenyl-hydrazine; hydroxamic acids such as phenylhydroxamic acid, p-hydroxyphenyl-hydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy- 1,1'-binaphthyl, 6,6'-dibromo-2,2'-dihydroxy-1,1'-binaphthyl, and bis(2-hydroxy-1-naphthyl)methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexose-reductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione and the like; chromans such as 2,2-dimethyl-7-t-butyl-6-hydroxychroman; 1,4-dihydropyridines such as 2,6-dimethoxy-3,5-dicarboethoxy- 1,4-dihydropyridine; bisphenols such as bis(2-hydroxy-3-t-butyl-5-methylphenyl) methane, 2,2-bis(4-hydroxy-3-methylphenyl)-propane, 4,4-ethylidene-bis(2-t-butyl-6-methylphenol), 1,1-bis(2-hydroxy-3,5-dimethylphenyl) -3,5,5-trimethylhexane, and 2,2-bis(3,5-dimethyl-4-hydroxyphenyl)-propane; ascorbic acid derivatives such as 1-ascorbyl palmitate and ascorbyl stearate; aldehydes and ketones such as benzyl and biacetyl; 3-pyrazolidones and certain indane-1,3-diones and the like.

Particularly preferred reducing agents are compounds which have at least one phenolic hydroxyl group and its ortho position is substituted with a functional group other than hydrogen atom. They may contain one phenol ring, or two or more phenol rings in their molecules.

Specific examples of the preferred reducing agents are those disclosed in the Japanese Patent Application No. 8-83566, [0062] to [0074], and more specifically, the compounds of [Formula 28] to [Formula 32] falling within formulas (Ia), (Ib), (IIa), (IIb), (III), (IVa), (IVb) and the like.

The amount of the reducing agent of the present invention may preferably be $1\times10^{-2}$ to 10 mole, particularly from $1\times10^{-2}$ to 1.5 mole based on per mol of silver.

According to the present invention, the molar ratio of the reducing agent and the high contrast agent may preferably be selected from the range of from $1:10^{-3}$ to $1:10^{-1}$.

The high contrast agent used for the present invention will be explained. The high contrast agent used for the present invention may be selected from the aforementioned various known materials. In addition, the agent can be selected form the compounds of formula (I) disclosed in the Japanese Patent Application No. 8-83566, more specifically, Compounds I-1 to I-76, the compounds disclosed in the references cited in [0035], and compounds containing quaternary nitrogen atoms, specifically, Compounds P-1 to P-26 and T-1 to T-18.

Particularly preferred high contrast agents include the compounds of formula (I) disclosed in the Japanese Patent Application No. 8-83566, and the acrylonitrile compounds disclosed in U.S. Pat. No. 5,545,515, specifically, Compounds CN-1 to CN-13 disclosed therein. The high contrast agent may be used in an amount of from $1\times10^{-6}$ to $1\times10^{-1}$ mole, preferably from $1\times10^{-5}$ to $5\times10^{-2}$ mole, most preferably from $5\times10^{-5}$ to $1\times10^{-2}$ mole based on per mole of silver. For the addition of the high contrast agents, they may be dissolved in water or a suitable organic solvent, for example, alcohols such as methanol, ethanol, propanol, and fluorinated alcohol, ketones such as acetone, and methyl ethyl ketone (MEK), dimethylformamide (DMF), dimethyl sulfoxide (DMSO) and the like. Alternatively, they may be dispersed as particles according to the known emulsification dispersion method or solid dispersion method.

According to the present invention, amine derivatives, onium salts, disulfide derivatives, hydroxylamines and the like, which are known as high contrast accelerators, may also be used in combination.

The organic binder used for the present invention will be explained. The binder used in the present invention can be selected from known natural or synthetic resins such as gelatin, polyvinyl acetal, polyvinyl chloride, polyvinyl acetate, cellulose acetate, polyolefin, polyester, polystyrene, polyacrylonitrile, polycarbonate and the like. Copolymers and terpolymers may also be used. Preferred polymers are polyvinyl butyral, butyl ethyl cellulose, methacrylate copolymer, maleic anhydride ester copolymer, polystyrene and butadiene/styrene copolymer. Two or more of these polymers can be used in combination, if required. The polymers are used in an amount sufficient to hold other components in the polymer, namely, they are used in an effective range to function as a binder. Those skilled in the art can appropriately determine the effective range. In order to hold at least the organic silver salt, a guide of the proportion of the binder to the organic silver salt may preferably range from 15:1 to 1:2, more preferably from 8:1 to 1:1.

As binders for silver halide emulsion layers and other hydrophilic colloid layers, the binders may be used which are disclosed in JP-A-2-18542 (the abbreviation "JP-A" as used herein means an "unexamined published Japanese patent application") at lines 1 to 20 in lower right column on page 3.

Aqueous dispersions of thermoplastic resins disclosed in the Japanese Patent Application Nos. 8-316935 and 8-316936 may also be used as the binder.

Preferred examples of the thermoplastic resins used for the present invention include, for example, polyvinyl alcohols, cellulose acetate butyrates, cellulose acetate propionates, styrene/butadiene copolymers, polyvinyl acetals (e.g., polyvinyl formal, polyvinyl butyral), polyurethanes, polyvinyl acetates, acrylic resins (including acrylic rubber) and the like.

The average molecular weight of the polymers may generally be in the range of about 1,000 to 100,000 as weight average molecular weight (Mw).

The aqueous dispersion of thermoplastic resin used for the present invention can be produced by a known dispersion-forming technique. For example, a resin-in-water type dispersion can be produced by adding 5 to 80% by weight of plasticizer (e.g., saturated or unsaturated higher fatty acid esters) and 1 to 30% by weight of alkylarylsulfonic acid salt as a dispersing agent to the resin powder, heating the mixture to a temperature higher than Tg of the resin to dissolve the resin, adding water to the mixture with stirring by an emulsification-dispersing apparatus to temporally form a water-in-resin type dispersion, and further adding water to the dispersion to cause phase transition. A smaller particle size of the dispersion is more preferred, and the size may be controlled by viscosity of the resin solution phase and shearing force provided by a dispersing apparatus. The particles may preferably be made smaller to an average particle size of 1 $\mu$m or less (usually 0.01 $\mu$m or more).

Commercially available aqueous dispersions may also be used. Examples include aqueous dispersions of polyvinyl butyral such as Butvar Dispersion FP and BR (both are trade names of Monsanto Co.), aqueous dispersions of anionic polyurethane resins such as Adeka Bontiter HUX-350, 232, 551, 290H and 401 (these are trade names of Asahi Denka Kogyo Co., Ltd.), aqueous dispersions of aqueous vinyl/urethane resins such as KR-120, KR-134, KC-1, KR-2060 and KR-173 (these are products by Kohyo Sangyo Co., Ltd.) and Maruka UV Bond #10, #31 and #50 (these are products by Saiden Chemical Co., Ltd.) and the like. In addition, styrene/butadiene copolymer identified as universal product codes of #1500, #1502, #1507, #1712, #1778 in the art may also be used among Sumitomo SBR latexes (Sumitomo Chemical Co., Ltd.), JSR latexes (Japan Synthetic Rubber Co., Ltd.), Nipol latexes (Nippon Xeon Co., Ltd.).

Acrylic latexes, generally known as acrylic rubber, for example, Nipol AR31 and AR32, and Hycar 4021 (these are trade names of Nippon Xeon Co., Ltd.) may also be used.

The homopolymers and copolymers of polyvinyl butyral used for the aforementioned aqueous dispersions of polyvinyl butyral may preferably have an average molecular weight of about 1,000 to 100,000 as weight average molecular weight (Mw). The ratio of the polyvinyl butyral component in the copolymers may preferably be 30% by weight or more.

The homopolymers and copolymers of polyurethane used for the aforementioned aqueous dispersions of polyurethane may preferably have an average molecular weight of about 1,000 to 100,000 as weight average molecular weight (Mw). The ratio of the polyurethane component in the copolymers may preferably be 30% by weight or more.

The styrene/butadiene copolymer latexes may preferably have a copolymerization ratio of styrene and butadiene (weight ratio) within the range of 10/90 to 90/10, more preferably 20/80 to 60/40. Those having the ratio of 60/40 to 90/10, called high styrene latexes, may preferably be used in combination with a latex of a low styrene content (the ratio is 10/90 to 30/70) for improvement of scratch resistance and mechanical strength of the photosensitive layer. The mixing ratio (weight ratio) may preferably be within the range of 20/80 to 80/20.

Examples of the high styrene latexes include, for example, commercially available products such as JSR 0051, 0061 (these are trade names of Japan Synthetic Rubber Co., Ltd.), Nipol 2001, 2057, 2007 (trade names of Nippon Xeon Co., Ltd.) and the like. Examples of the latex of a low styrene content include, for example, ordinary latexes other than those specifically mentioned as high styrene latexes, such as JSR #1500, #1502, #1507, #1712, and #1778.

The thermoplastic resin according to the present invention may be used in an effective range to function as a binder, and the effective range may suitably be determined by those skilled in the art. In order to hold at least the organic silver salt in a layer, a guide of the proportion of the binder to the organic silver salt may preferably range from 15:1 to 1:2, particularly preferably 8:1 to 1:1.

An antifoggant may be contained in the heat-developable image-recording material of the invention. The most effective antifoggant is mercury ion. Use of a mercury compound as the antifoggant in heat-developable image-recording materials is disclosed in, for example, U.S. Pat. No. 3,589,903. Mercury compounds, however, are undesirable from the environmental viewpoint. As non-mercury antifoggants, preferred examples include those disclosed in U.S. Pat. Nos. 4,546,075 and 4,452,885 and JP-A-59-57234.

Particularly preferred non-mercury antifoggants are compounds disclosed in U.S. Pat. Nos. 3,874,946 and 4,756,999, or heterocyclic compounds having at least one substituent represented by $—C(X^1)(X^2)(X^3)$ wherein $X^1$ and $X^2$ are halogen atoms such as F, Cl, Br, and I, and $X^3$ is hydrogen or halogen. Preferred examples of the antifoggant are shown below.

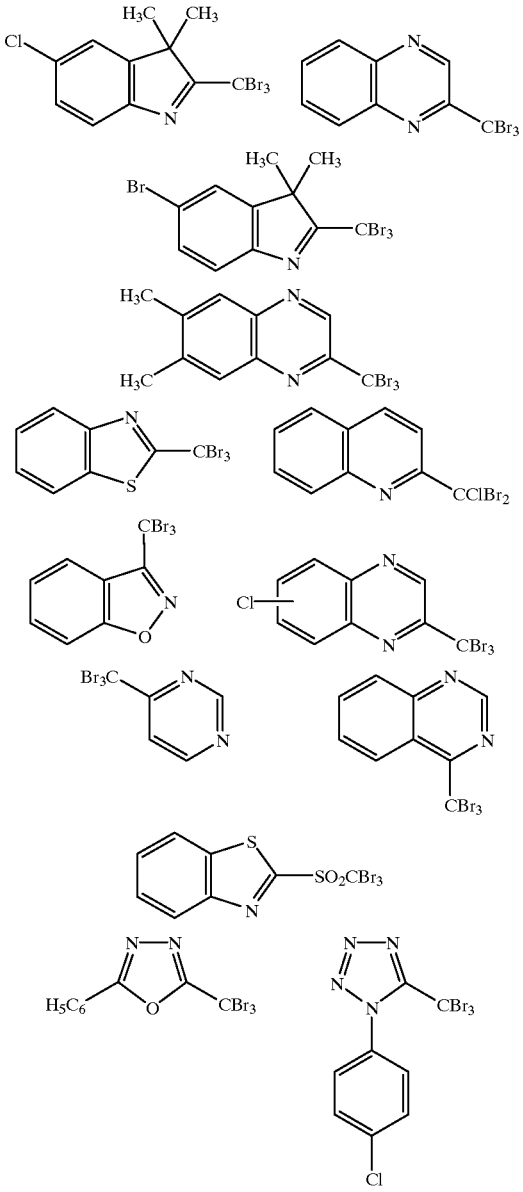

-continued

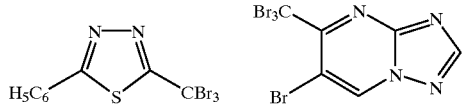

Further preferred antifoggants are disclosed in U.S. Pat. No. 5,028,523, British Patent Application Nos. 92221383.4, 9300147.7 and 9311790.1.

For the preparation of the heat-developable image-recording material of the present invention, a sensitizing dye such as disclosed in JP-A-63-159841, JP-A-60-140335, JP-A-63-231437, JP-A-63-259651, JP-A-63-304242, JP-A-63-15245, U.S. Pat. Nos. 4,639,414, 4,740,455, 4,741,966, 4,751,175, and 4,835,096 may be used.

Useful sensitizing dyes which can be used in the present invention are described in Research Disclosure No. 17643, item IV-A (page 23, December, 1978) and ibid. No. 1831, item X (page 437, August, 1979) and the references cited therein.

Sensitizing dyes having a spectral sensitivity suitable for spectral characteristics of light sources for scanners can be advantageously chosen.

For example, (A) for an argon laser beam source, the simple merocyanines described in JP-A-60-162247, JP-A-2-48653, U.S. Pat. No. 2,161,331 and West German Patent 936,071 and Japanese Patent Application No. 3-189532; (B) for a helium-neon laser beam source, the trinuclear cyanine dyes described in JP-A-50-62425, JP-A-54-18726 and JP-A-59-102229; (C) for an LED beam and red semiconductor laser beam source, the thiacarbocyanines described in JP-B-48-42172, JP-B-51-9609, JP-B-55-39818, JP-A-62-284343 and JP-A-2-105135; and (D) for an infrared semiconductor laser beam source, the tricarbocyanines described in JP-A-59-191032 and JP-A-60-80841 and the dicarbocyanines having 4-quinoline nucleus described in JP-A-59-192242, and JP-A-3-67242, formulas (IIIa) and (IIIb) may be used.

Each of these sensitizing dyes may be used alone or in any combination. A combination of sensitizing dyes is frequently used, especially for supersensitization. The emulsion may also contain, together with the sensitizing dye, a dye which itself does not have sensitizing effect or a substance which itself does not substantially absorb visible light, but shows supersensitization. Examples include those disclosed in JP-A-5-341432.

Light exposure of the heat-developable image-recording material of the present invention may preferably be performed by using Ar laser (488 nm), He—Ne laser (633 nm), red semiconductor laser (670 nm), infrared semiconductor laser (780 nm, 830 nm) or the like.

The heat-developable image-recording material of the present invention may have a layer containing a dye as an antihalation layer. For Ar laser, He—Ne laser, and red semiconductor laser, the dye is added in such an amount that the layer has absorbance of 0.3 or more, preferably 0.8 or more for a light at a wavelength for exposure within the range of 400 nm to 750 nm. For infrared semiconductor laser, the dye is added in such an amount that the layer has absorbance of 0.3 or more, preferably 0.8 or more for a light at a wavelength for exposure within the range of 750 nm to 1500 nm. The dye may be used alone or in combination of several types.

The dye may be added to a dye layer close to the support on the side of the photosensitive layer, i.e., image-recording layer, or opposite side of the photosensitive layer.

The support used for the present invention may be, for example, a paper sheet, a synthetic paper sheet, a paper sheet laminated with a synthetic resin (e.g., polyethylene, polypropylene, polystyrene), a plastic film (e.g., polyethylene terephthalate, polycarbonate, polyimide, Nylon, or cellulose triacetate film), metal plate (e.g., aluminum, aluminum alloy, zinc, iron, or copper plate), a paper sheet or a plastic film laminated or deposited with metals as mentioned above or the like.

When a plastic film is passed through a heat-developing apparatus, the film is generally stretched in the dimension. If the material are used as printing photosensitive materials, the stretch causes a serious problem at the time of precision multi-color printing. Accordingly, in the present invention, it is preferred to use a film with little change in the dimension. Examples of such films include, for example, those composed of styrene polymers having a syndiotactic structure and polyethylene terephthlate subjected to heat relaxation treatment. Films having a high glass transition point are also preferred, and for example, films of polyether ethyl ketone, polystyrene, polysulfone, polyether sulfone, polyarylate or the like may be used.

The heat-developable image-recording material of the present invention may contain a mercapto compound, a disulfide compound or a thione compound, for example, to control the development by inhibition or acceleration, to improve spectral sensitization efficiency, and to improve storage stability before or after the development.

When a mercapto compound is used in the present invention, a mercapto compound having any chemical structure may be used, and those represented by Ar—SM or Ar—S—S—Ar are preferred, wherein M is a hydrogen atom or an alkali metal atom, and Ar is an aromatic ring or condensed aromatic ring containing one or more nitrogen, sulfur, oxygen, selenium or tellurium atoms, preferably a heteroaromatic ring such as benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g., Br, Cl), hydroxyl group, amino group, carboxyl group, an alkyl group (e.g., an alkyl having one or more carbon atoms, preferably from 1 to 4 carbon atoms), and an alkoxyl group (e.g., an alkoxyl group having one or more carbon atoms, preferably from 1 to 4 carbon atoms). Examples of the mercapto-substituted heteroaromatic compound include 2-mercaptobenzimidazole, 2-mercaptobenzoxazole, 2-mercaptobenzothiazole, 2-mercapto-5-methylbenzimidazole, 6-ethoxy-2- mercaptobenzothiazole, 2,2'- dithiobis-(benzothiazole), 3-mercapto-1,2,4-triazole, 4,5-diphenyl-2-imidazolethiol, 2-mercapto-imidazole, 1-ethyl-2 -mercaptobenzimidazole, 2-mercap toquinoline, 8-mercaptopurine, 2-mercapto-4(3H) -quinazolinone, 7-trifluoromethyl-4-quinolinethiol, 2,3,5,6-tetra-chloro-4-pyridinethiol, 4-amino-6-hydroxy-2-mercaptopyrimidine monohydrate, 2- amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methyl-pyrimidine hydrochloride, 3-mercapto-5-phenyl-1,2,4-triazole, 2-mercapto-4-phenyloxazole and the like. However, the present invention is not limited to these examples.

The amount of the mercapto compound may preferably be from 0.001 to 1.0 mole, more preferably from 0.01 to 0.3 mole based on per mole of silver in an emulsion layer as the image-recording layer.

For the preparation of the photosensitive silver halide used for the present invention, methods well known in the art, e.g., the methods described in Research Disclosure, No. 17029 (June, 1978) and U.S. Pat. No. 3,700,458, can be used. More specifically, applicable methods for the present invention include a method comprising the step of adding a halogen-containing compound to a ready prepared organic silver salt to convert a part of silver of the organic silver salt into a photosensitive silver halide, and a method comprising the step of preparing photosensitive silver halide grains by adding a silver-supplying compound and a halogen-supplying compound to a solution of gelatin or another polymer and then mixing the prepared grains with an organic silver salt. In particular, the latter method is preferred for the present invention. As for a grain size of the photosensitive silver halide, smaller grains are desirable to prevent cloudiness of the photosensitive material after image formation. Specifically, the grain size may preferably be not greater than 0.20 $\mu$m, preferably from 0.01 to 0.15 $\mu$m, more preferably from 0.02 to 0.12 $\mu$m. The term "grain size" used herein means "ridge length" of silver halide grains when the silver halide grains are regular crystals in cubic or octahedral form. Where silver halide grains are tabular grains, the term means the diameter of a circle having the same area as a projected area of the main surface of the tabular grain. Where the silver halide grains are irregular crystals, such as spherical or rod-like grains, the term means the diameter of a sphere having the same volume as the grain.

Examples of the form of silver halide grains include a cubic form, octahedral form, tabular form, spherical form, rod-like form and potato-like form. In particular, cubic grains and tabular grains are preferred for the present invention. When tabular silver halide grains are used, an average aspect ratio may be from 100:1 to 2:1, preferably from 50:1 to 3:1. Silver halide grains having round corners are also preferably used in the present invention. Surface index (Miller index) of outer surfaces of the photosensitive silver halide grains is not particularly limited. However, it is desirable that [100] plane be present in a high proportion which can achieve high spectral sensitizing efficiency when a spectral sensitizing dye adsorbed thereto. The proportion of [100] plane may be not lower than 50%, preferably at least 65%, and more preferably at least 80%. The proportion of [100] plane can be determined using the method described in T. Tani, J. Imaging Sci., 29, 165 (1985), where the difference in adsorption of a sensitizing dye to [111] plane and [100] plane is utilized. The halide composition of the photosensitive silver halide is not particularly limited. The halide may be any of silver chloride, silver chlorobromide, silver bromide, silver iodobromide, silver iodochlorobromide and silver iodide as mentioned above. Silver bromide or silver iodobromide may preferably used in the present invention Silver iodobromide is most preferred, and a suitable iodide content may be from 0.1 to 40% by mole, preferably from 0.1 to 20% by mole. The halide composition may have a uniform distribution in the grains, or the compositions may change stepwise or continuously in the grains. For instance, silver iodobromide grains having a higher iodide content in the grain may preferably be used, or silver halide grains having a core/shell structure may also be preferably used. Preferably, core/shell grains having preferably a double to quintuple structure, more preferably a double to quadruple structure may be used.

It is desirable that the photosensitive silver halide grains used in the present invention contain at least one metal complex selected from the group consisting of rhodium complexes, rhenium complexes, ruthenium complexes, osmium complexes, iridium complexes, cobalt complexes and iron complexes. These metal complexes may be used alone or in combination of two or more complexes comprising the same or different metals. Suitable content of the metal complexes may be from 1 nmole to 10 mmole, preferably from 10 nmole to 100 $\mu$mole based on per mole of silver. As for specific structures of such metal complexes, the metal complexes having the structures described in JP-A-7-225449 can be used. As for the complexes of cobalt and iron, hexacyanometal complexes may preferred be used. More specifically, ferricyanate ion, ferrocyanate ion and hexacyanocobaltate ion may be used. However, the metal complexes are not limited to these examples. The metal complex as mentioned above may be added, for example, uniformly in the silver halide grain, added in a higher concentration in the core part, or added in a higher concentration in the shell part, and a way of the addition of the metal complex is not particularly limited.

The photosensitive silver halide grains can be desalted by washing treatment according to a method well known in the art, such as the noodle method, the flocculation method or the like. However, the grains may not be desalted in the present invention.

Furthermore, it is desirable that the photosensitive silver halide grains used in the present invention are chemically sensitized. For the chemical sensitization, as well known in the art, sulfur sensitization method, selenium sensitization method and tellurium sensitization method can be employed. In addition, a precious metal sensitization method using a gold, platinum, palladium or iridium compound and a reduction sensitization method can be applied. For sulfur, selenium, and tellurium sensitization methods, known compounds can be used, and for example, the compounds described in JP-A-7-128768 can be used. As the tellurium sensitizer, diacyltellurides, bis(oxycarbonyl)tellurides, bis (carbamoyl)tellurides, diacyltellurides, bis(oxycarbonyl) ditelluride, bis(carbamoyl)ditellurides, compounds having P═Te bond, tellurocarboxylates, Te-organyl tellurocarboxylic acid esters, di(poly)tellurides, tellurides, tellurols, telluroacetals, tellurosulfonates, compounds having P—Te bond, tellurium-containing heterocyclic rings, tellurocarbonyl compounds, inorganic tellurium compounds and colloidal tellurium may be used. For the precious metal sensitization method, chloroauric acid, potassium chloroaurate, potassium aurithiocyanate, gold sulfide, gold selenide and the compounds described in U.S. Pat. No. 2,448,060 and British Patent 618,061 may be preferably used. Specific examples of a compound suitable for the reduction sensitization include ascorbic acid and thiourea dioxide, as well as stannous chloride, aminoiminomethanesulfonic acid, hydrazine derivatives, borane compounds, silane compounds and polyamine compounds. The reduction sensitization may be performed by ripening emulsions under a pH of above 7 or a pAg of below 8.3. The reduction sensitization may also be performed by introducing a part of a single addition of silver ion during the grain formation.

The amount of the photosensitive silver halide used in the present invention may preferably be from 0.01 to 0.5 mole, more preferably from 0.02 to 0.3 mole, and more preferably from 0.03 to 0.25 mol based on per mole of the organic silver salt. Examples of a method and conditions for mixing the photosensitive silver halide with a separately prepared organic silver salt include, for example, a method of mixing the silver halide grains and the organic silver salt by means of a high-speed stirrer, a ball mill, a sand mill, a colloidal mill, a vibration mill, a homogenizer or the like, or a method of adding a ready prepared photosensitive silver halide to an organic silver salt at any stage of its preparation. However, the mixing method and conditions are not particularly limited so long as the advantages of the invention can be fully achieved.

The heat-developable image-recording material of the present invention is preferably a so-called single-sided recording material comprising a support having on one side thereof at least one image-recording layer containing a silver halide emulsion and on the other side thereof a back layer (backing layer).

The single-sided recording material of the present invention may contain a matting agent to improve transferability. The matting agent is, in general a fine particle of a water-insoluble organic or inorganic compound. Any matting agent may be employed, and those well known in the art may be used, such as organic matting agents described in U.S. Pat. Nos. 1,939,213, 2,701,245, 2,322,037, 3,262,782, 3,539,344 and 3,767,448, or inorganic matting agents described in U.S. Pat. Nos. 1,260,772, 2,192,241, 3,257,206, 3,370,951, 3,523,022 and 3,769,020. Specific examples of the organic compound which can be used as the matting agent include, for example, water-dispersible vinyl polymers such as polymethyl acrylate, polymethyl methacrylate (PMMA), polyacrylonitrile, acrylonitrile/$\alpha$-methylstyrene copolymer, polystyrene, styrene/divinylbenzene copolymer, polyvinyl acetate, polyethylene carbonate and polytetrafluoroethylene; cellulose derivatives such as methyl cellulose, cellulose acetate and cellulose acetate propionate; starch derivatives such as carboxy starch, carboxynitrophenyl starch and urea/formaldehyde/starch reaction product; and gelatin hardened with a known hardening agent and hardened gelatin subjected to coacervation hardening so as to be a microcapsule hollow particle. Examples of the inorganic compound include, for example, silicon dioxide, titanium dioxide, magnesium dioxide, aluminum oxide, barium sulfate, calcium carbonate, silver chloride desensitized by a known method, silver bromide desensitized by a known method, glass, diatomaceous earth and the like. The matting agent may be used as a mixture of different substances as required. The size and shape of the matting agent are not particularly limited and the matting agent may have any particle size. A matting agent having a particle size of from 0.1 to 30 $\mu$m may preferably used to carry out the present invention. The matting agent may have either a narrow or broad particle size distribution. However, the matting agent may greatly affect the haze or surface gloss of a coated layer, and accordingly, the particle size, shape and particle size distribution may preferably be controlled to meet a desired purpose at the preparation of the matting agent or by mixing several matting agents.

The matting degree of the backing layer may preferably be from 10 to 3,000 seconds, more preferably from 100 to 500 seconds as indicated by the Beck's smoothness,.

In the present invention, the matting agent may preferably be incorporated in the outermost surface layer of the recording material or a layer which functions as the outermost surface layer, or alternatively, in a layer close to the outer surface or a layer which acts as a so-called protective layer.

The binder suitable for the backing layer of the present invention may be transparent or translucent, and generally colorless. Examples include natural polymers and synthetic resins including homopolymers and copolymers, and other film-forming media. Specific examples include, for example, gelatin, gum arabic, polyvinyl alcohol, hydroxyethyl cellulose, cellulose acetate, cellulose acetate butyrate, polyvinylpyrrolidone, casein, starch, polyacrylic acid, polymethylmethacrylic acid, polyvinyl chloride, polymethacrylic acid, styrene/maleic anhydride copolymer, styrene/acrylonitrile copolymer, styrene/butadiene copolymer, polyvinyl acetal (e.g., polyvinyl formal, polyvinyl butyral), polyester, polyurethane, phenoxy resin, polyvinylidene chloride, polyepoxide, polycarbonate, polyvinyl acetate, cellulose ester and polyamide. The binder may be applied for coating in the form of a solution in water or an organic solvent, or in the form of an emulsion.

In the present invention, it is desirable that the backing layer has a maximum absorption of from 0.3 to 2 in a desired wavelength range, and preferably has an IR absorption of 0.5 to 2 and an absorption of 0.001 or more and less than 0.5 in a visible region. Furthermore, it is preferable that the backing layer is also act as an antihalation layer having an optical density of 0.001 or more and less than 0.3.

When antihalation dyes are used in the present invention, the dyes may be any compounds so far that they have an intended absorption in a desired wavelength region and sufficiently low absorption in a visible region, and also provide an absorption spectral property desired for the aforementioned backing layer. Examples of such dyes include the compounds described in JP-A-7-13295 and U.S. Pat. No. 5,380,635, and the compounds described in JP-A-2-68539 (from page 13, lower left column, line 1, to page 14, lower left column, line 9) and JP-A-3-24539 (from page 14, lower left column, to page 16, lower right column). However, the scope of the present invention is not limited to these examples.

A backside resistive heating layer as described in U.S. Pat. Nos. 4,460,681 and 4,374,921 can also be applied to the heat-developable image-recording material of the present invention.

The heat-developable image-recording material of the present invention may have a surface protecting layer, for example, to prevent adhesion of the image-recording layer. The surface protecting layer may contain any anti-adhesion material. Suitable examples of the anti-adhesion material include, for example, wax, silica particles, a styrene-containing elastomeric block copolymer (e.g., styrene/butadiene/styrene, styrene/isobutylene/styrene), cellulose acetate, cellulose acetate butyrate, cellulose propionate, and a mixture thereof.

In the emulsion layer and the protective layer for the emulsion layer of the present invention, a light-absorbing material and a filter dye such as those described in U.S. Pat. Nos. 3,253,921, 2,274,782, 2,527,583 and 2,956,879 can be used. The dyes can be mordanted as described, for example, in U.S. Pat. No. 3,282,699.

In the image-recording layer and the protective layer for the image-recording layer of the present invention, a delustering agent, such as starch, titanium dioxide, zinc oxide, silica, and polymer beads including the beads described in U.S. Pat. Nos. 2,992,101 and 2,701,245 may be added. The matting degree on the emulsion surface can be freely chosen so far that the star dust trouble does not occur. The degree may preferably be within a range of from 1,000 to 10,000 seconds, particularly from 2,000 to 10,000 seconds as indicated by the Beck's smoothness.

EXAMPLES

Example 1

<Preparation of organic acid silver salt emulsion>

840 g of behenic acid, and 85 g of stearic acid were added to 12 liters of water, and the mixture was added with 48 g of sodium hydroxide and 63 g of sodium carbonate dissolved in 1.5 liters of water and kept at 90° C. After the mixture was stirred for 30 minutes, the mixture was cooled to 50° C. and then added with 1.1 liters of 1% aqueous N-bromosuccinimide. Then, the mixture was added portionwise with 2.3 liters of 17% aqueous silver nitrate with stirring. The temperature of the mixture was adjusted to 35° C., and 1.5 liters of aqueous 2% potassium bromide was added to the mixture over 2 minutes with stirring, and stirring was continued for 30 minutes. Then, 2.4 liters of 1% aqueous N-bromosuccinimide was added to the mixture. To the aqueous mixture, 3,300 g of 1.2 wt % solution of polyvinyl acetate in butyl acetate was added with stirring, and the mixture was left stand for 10 minutes to allow the mixture separate into two layers. The aqueous layer was removed, and the remained gel was washed twice with water. The mixture of the silver behenate/stearate and silver bromide in gel form obtained as described above was dispersed in 1,800 g of 2.6% solution of polyvinyl butyral (Denka Butyral #3000-K, produced by Denki Kagaku Kogyo Co., Ltd.) in isopropyl alcohol, and further dispersed with 600 g of polyvinyl butyral (Denka Butyral #4000-2, produced by Denki Kagaku Kogyo Co., Ltd.) and 300 g of isopropyl alcohol to obtain an emulsion containing the silver salt of the organic acid (needle grains having an average short axis length of 0.05 $\mu$m, average long axis length of 1.2 $\mu$m and the variation coefficient of 25%).

<Preparation of coating composition for emulsion layer>

To the organic acid silver salt emulsion obtained above, the following ingredients were added in the indicated amounts per mole of silver. 10 mg of sodium phenylthiosulfonate, 70 mg of Dye A, 2 g of 2-mercapto-5-methylbenzimidazole, 21.5 g of 4-chlorobenzophenone-2-carboxylic acid, 580 g of 2-butanone, and 220 g of dimethylformamide at 25° C. with stirring, and the mixture was left stand for 3 hours. Then, the resulting mixture was further added with 8 g of 5-tribromomethylsulfonyl-2-methylthiadiazole, 6 g of 2-tribromomethylsulfonylbenzothiazole, 5 g of 4,6-ditrichloromethyl-2-phenyltriazine, 2 g of Disulfide Compound a, 0.4 mol of 1,1-bis(2-hydroxy-3,5-dimethylphenyl)-3,5,5-trimethylhexane, $5\times10^{-4}$ mol of the compound of the formula (I) or (II) shown in Table 1, 5 g of tetrachlorophthalic acid, 1.1 g of Megafac F-176P (fluorine-containing surfactant, produced by Dai-Nippon Ink & Chemicals, Inc.), 590 g of 2-butanone, and 10 g of methyl isobutyl ketone with stirring.

<Preparation of coating composition for a protective layer for an emulsion surface>

75 g of CAB171-15S (cellulose acetate butyrate, produced by Eastman Chemical Co., Ltd.), 5.7 g of 4-methylphthalic acid, 15 g of tetrachlorophthalic anhydride, 12.5 g of phthalazine, 0.3 g of Megafac F-176P, 2 g of Silidex H31 (true spherical silica, produced by Dokai Chemical Co., Ltd., average size of 3 $\mu$m), and 7 g of Sumidur N3500 (polyisocyanate, produced by Sumitomo Bayer Urethane Co., Ltd.) were dissolved in a mixture of 3,070 g of 2-butanone and 30 g of ethyl acetate to obtain a coating composition.

<Preparation of support having back layer>

On a polyethylene terephthalate sheet having moisture-proof undercoat layers containing polyvinylidene chloride on both sides, simultaneous multilayer coating of a back layer and a protective layer for the back layer surface was performed by using aqueous solutions to achieve coated amounts of ingredients per 1 $m^2$ as follows: for the back layer, 1.5 g of gelatin, 30 mg of sodium dodecylbenzenesulfonate, 100 mg of 1,2-bis (vinylsulfonylacetamido)ethane, 50 mg of Dye a, 100 mg of Dye b, 30 mg of Dye c, 50 mg of Dye d, and 1 mg of Proxel were used, and for the protective layer for the back layer surface, 1.5 g of gelatin, 20 mg of polymethyl methacrylate particles having an average diameter of 2.5 $\mu$m, 15 mg of sodium p-dodecylbenzenesulfonate, 15 mg of sodium dihexyl-$\alpha$-sulfosuccinate, 50 mg of sodium acetate, and 1 mg of Proxel were used.

The coating solution for emulsion layer was coated on the support prepared as described above to achieve 2 g/$m^2$ of the coated amount of silver, and then the coating solution for protective layer for the emulsion layer surface was coated on the emulsion layer so that a dry thickness of the coated layer was 2 $\mu$m.

Dye A

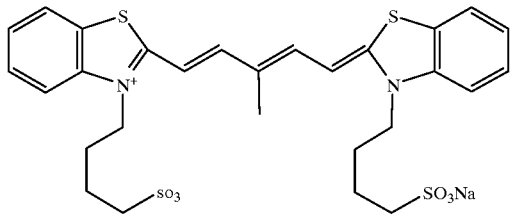

Dye a

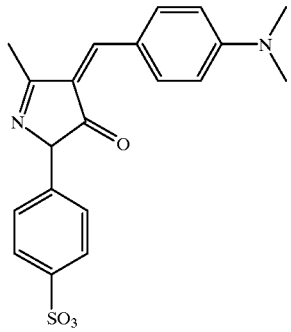

Disulfide Compound a

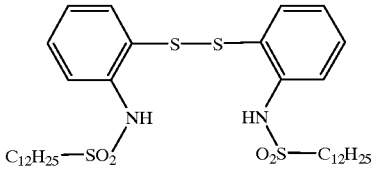

Dye b

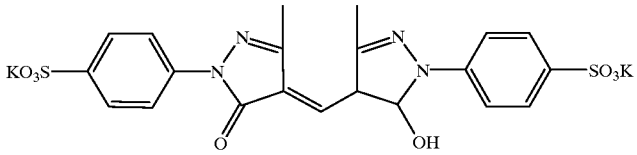

Dye c

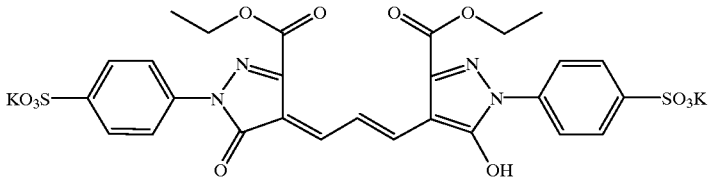

-continued

Dye d

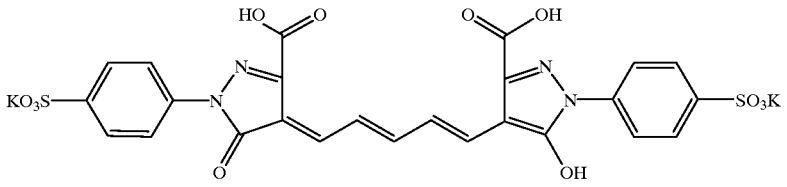

<Evaluation of photographic performance>

Each of the obtained heat-developable image-recording materials was exposed by using a 633 nm He—Ne laser sensitometer, and treated (developed) at 115° C. for 20 seconds or 30 seconds. The image obtained was evaluated by a densitometer. The results of measurement were evaluated as Dmax and sensitivity (a logarithm of the light exposure amount necessary to give a density higher than Dmin by 3.0). The sensitivity was indicated as a relative value based on the value obtained for a blank.

The results are shown in Table 1.

TABLE 1

| | Compound of the present invention | Development: 115° C., 20 sec Dmax | Development: 115° C., 20 sec Sensitivity(S) | Development: 115° C., 30 sec Dmax | Development: 115° C., 30 sec Sensitivity(S) |
|---|---|---|---|---|---|
| 1 | Blank* | 1.51 | ±0 | 1.99 | ±0 |
| 2 | I-1 | 1.88 | +0.22 | 2.15 | +0.21 |
| 3 | I-5 | 1.94 | +0.29 | 2.10 | +0.17 |
| 4 | I-8 | 1.90 | +0.25 | 2.08 | +0.17 |
| 5 | I-9 | 1.73 | +0.13 | 2.03 | +0.09 |
| 6 | I-10 | 1.70 | +0.13 | 2.02 | +0.08 |
| 7 | I-13 | 1.82 | +0.17 | 2.05 | +0.11 |

*Comparative Example

It can be understood that, by using the compounds of the present invention, high sensitivity and high Dmax can be obtained, and that heat development time can be shortened.

Example 2

In the procedure of Example 1, 1-formy-2-(O-methoxyphenyl)hydrazine was added to the coating solution for emulsion layer in an amount of $6.5\times10^{-3}$ mol per 1 g of silver as a high contrast agent. Samples were prepared and their performances were evaluated in the same manner as in Example 1 except for the above modification. The results are shown in Table 2. Table 2 shows Dmax and gradation γ. The gradation γ is a gradient of a line connecting points on the characteristic curve at densities of 0.3 and 3.0.

It can be understood that high Dmax and high contrast were obtained in a short development time by using the compounds of the present invention.

TABLE 2

| | Compound of the present invention | Development: 117° C., 20 sec Dmax | Development: 117° C., 20 sec γ | Development: 117° C., 30 sec Dmax | Development: 117° C., 30 sec γ |
|---|---|---|---|---|---|
| 1 | Blank* | 3.87 | 7.1 | 4.15 | 10.3 |
| 2 | I-1 | 4.25 | 15.5 | 5.03 | 18.5 |
| 3 | I-5 | 4.48 | 18.2 | 5.11 | 19.9 |
| 4 | I-8 | 4.35 | 17.8 | 5.08 | 19.3 |

TABLE 2-continued

| | Compound of the present invention | Development: 117° C., 20 sec Dmax | Development: 117° C., 20 sec γ | Development: 117° C., 30 sec Dmax | Development: 117° C., 30 sec γ |
|---|---|---|---|---|---|
| 5 | I-9 | 4.21 | 9.1 | 4.89 | 13.6 |
| 6 | I-10 | 4.15 | 8.8 | 4.53 | 12.7 |
| 7 | I-13 | 4.20 | 10.2 | 4.70 | 14.4 |

*Comparative Example

Example 3

Samples 3a and 3b were prepared by using the following high contrast agents stead of the high contrast agent of Example 2.

Sample 3a

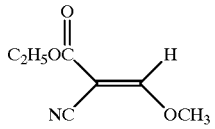

Sample 3b

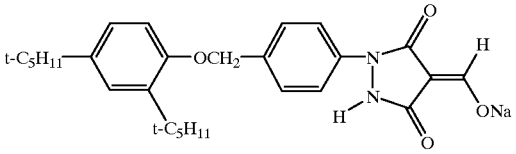

Results similar to those of Example 2 were obtained.

Example 4

(1) Preparation of support

PET having IV (intrinsic viscosity) of 0.66 (measured in phenol/tetrachloroethane=6/4 (weight ratio) at 25° C.) was obtained by using terephthalic acid and ethylene glycol in a conventional manner. The PET was pelletized and dried at 130° C. for 4 hours, melted at 300° C., and then extruded from a T-die and rapidly cooled to form an unstretched film having a thickness of 120 μm after thermal fixation.

The film obtained was stretched along the longitudinal direction by 3.3 times using rollers of different peripheral speeds, and then stretched along the transverse direction by 4.5 times using a tenter. The temperatures applied to these operations were 110° C. and 130° C., respectively. Then, the film was subjected to thermal fixation at 240° C. for 20 seconds, and relaxed by 4% along the transverse direction at the same temperature. The chuck of the tenter was then released, the both edges of the film were knurled, and the film was rolled at 4.8 kg/cm$^2$. A roll of the film having a width of 2.4 m, length of 3500 m, and thickness of 120 μm was obtained.

(2) Undercoat layer

| | |
|---|---|
| Undercoat layer (a) | |
| Polymer latex 1 (styrene/butadiene/hydroxyethyl methacrylate/divinylbenzene = 67/30/2.5/0.5 (% by weight), Tg = 20° C.) | 160 g/m$^2$ |
| 2,4-Dichloro-6-hydroxy-s-triazine | 4 mg/m$^2$ |
| Matting agent (polystyrene, average diameter; 2.4 μm) | 3 mg/m$^2$ |
| Undercoat layer (b) | |
| Alkali-treated gelatin (Ca++ content; 30 ppm, jelly strength; 230 g) | 50 mg/m$^2$ |
| Compound 1 (shown below) | 10 mg/m$^2$ |

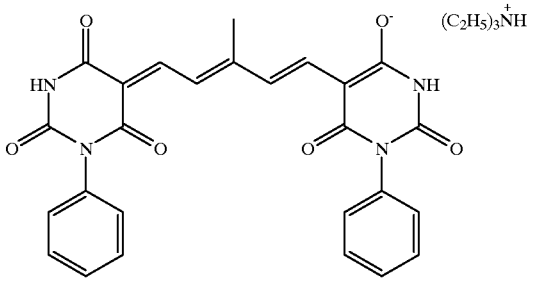

(3) Electroconductive layer (surface resistivity; $10^9$ Ω at 25° C. and 25% RH)

| | |
|---|---|
| Julimer ET-410 (Nihon Junyaku Co., Tg = 52° C.) | 38 mg/m$^2$ |
| $SnO_2$/Sb (weight ratio; 9/1, average particle size; 0.25 μm) | 120 mg/m$^2$ |
| Matting agent (Polymethyl methacrylate, average particle size; 5 μm) | 7 mg/m$^2$ |
| Denacol EX-614B (Nagase Kasei Co., Ltd.) | 13 mg/m$^2$ |
| (4) Protective layer (back surface) | |
| CHEMIPEARL S-120 (Mitsui Petrochemical Industries, Ltd., Tg = 77° C.) | 500 mg/m$^2$ |
| Snowtex-C (Nissan Chemical Industries, Ltd.) | 40 mg/m$^2$ |
| Denacol EX-614B (Nagase Kasei Co., Ltd.) | 30 mg/m$^2$ |

On both sides of the support, Undercoat layer (a) and Undercoat layer (b) were successively coated and dried at 180° C. for 4 minutes. On one of the surfaces coated with Undercoat layer (a) and Undercoat layer (b), an electroconductive layer and a protective layer were successively coated and dried at 180° C. for 4 minutes to obtain a PET support with back/undercoat layers.

(5) Heat treatment during transportation (5-1) Heat treatment

The PET support with back/undercoat layers obtained as described above was transported at a transportation speed of 20 m/min in a heat treatment zone set at a temperature of 130° C. and having a total length of 200 m at a tension of 5 kg/cm$^3$.

(5-2) Post-heat treatment

Subsequent to the above heat treatment, the support was subjected to a post-heat treatment at 140° C. and at a tension of 10 kg/cm$^2$ and then taken up.

(6) Image-forming layer (Preparation of silver halide grains)

11 g of phthalized gelatin, 30 mg of potassium bromide and 10 mg of sodium thiosulfonate were dissolved in 700 ml of water. The mixture was adjusted to pH 5.0 at a temperature of 35° C., and then added with 159 ml of an aqueous solution containing 18.6 g of silver nitrate and an aqueous solution containing 1 mol/l of potassium bromide by the control double jet method over 6.5 minutes while the pAg was kept at 7.7. 476 ml of an aqueous solution containing 55.4 g of silver nitrate and an aqueous halogen salt solution containing 1 mol/l of potassium bromide were added to the mixture by the control double jet method over 30 minutes while the pAg was kept at 7.7, and then 1 g of 4-hydroxy-6-methyl-1,3,3a,7-tetrazaindene was added. The pH of the mixture was lowered to allow coagulation precipitation for desalting, and then 0.1 g of phenoxyethanol was added. The pH and the pAg were adjusted to 5.9 and 8.2, respectively, to complete the preparation of silver bromide grains (cubic grains having an average grain size of 0.12 μm, a coefficient of variation of the diameter of projected area of 8%, and a (100) face ratio of 88%).

The silver halide grains obtained above was warmed to 60° C. and added with sodium thiosulfonate in an amount of $8.5\times10^{-4}$ mole per mole of silver, ripened for 120 minutes, and then rapidly cooled to 40° C. The mixture was then added with $1\times10^{-5}$ mol of Dye S-1, $5\times10^{-5}$ mol of 2-mercapto-5-methylbenzimidazole and $5\times10^{-5}$ mol of N-methyl-N'-{3-mercaptotetrazolyl}phenyl}urea, and rapidly cooled to 30° C. to obtain silver halide emulsion.

Dye S-1

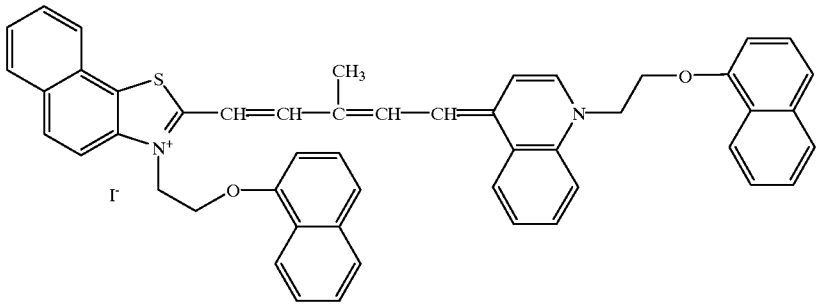

(Preparation of organic acid silver salt dispersion)

103 ml of 1N aqueous NaOH solution was added to 4.4 g of stearic acid and 39.4 g of behenic acid in 770 ml of distilled water with stirring at 90° C., and the mixture was allowed to react for 240 minutes and then cooled to 75° C. 112.5 ml of an aqueous solution containing 19.2 g of silver nitrate was added to the mixture over 45 seconds. The mixture was kept stand for 20 minutes to allow cooling to 30° C. The solid content was separated by suction filtration, and the solid was washed with water until the conductivity of the filtered water became 30 μS/cm. The solid content obtained as described above was added with 100 g of 10 wt % aqueous solution of hydroxypropylmethyl cellulose, and with water to give the total weight of 270 g, and then the mixture was roughly dispersed by an automatic mortar to obtain roughly dispersed organic acid silver salt. The roughly dispersed organic acid silver salt was dispersed by using a nanomizer (Nanomizer Co., Ltd.) under a pressure of 1000 kg/cm$^2$ at impact to obtain an organic acid silver salt dispersion. The organic acid silver salt grains contained in the organic acid silver salt dispersion obtained as described above were needle grains having an average short axis length of 0.04 μm, an average long axis length of 0.8 μm and a variation coefficient of 30%.

(Preparation of reducing agent dispersion)

850 g of water was added to 100 g of 1,1-bis(2-hydroxy-3,5-dimethyl-phenyl)-3,5,5-trimethylhexane and 50 g of hydroxypropyl cellulose, and the mixture was sufficiently stirred to form a slurry. The slurry was introduced into a vessel together with 840 g of zirconia beads having an average particle size of 0.5 mm, and dispersed by using a dispersing machine (¼G Sand Grinder Mill, Imex Co., Ltd.) for 5 hours to prepare a reducing agent dispersion.

(Preparation of organic polyhalogenide dispersion)

940 g of water was added to 50 g of tribromomethylphenylsulfone and 10 g of hydroxypropylmethyl cellulose, and the mixture was sufficiently stirred to form a slurry. The slurry was introduced into a vessel together with 840 g of zirconia beads having an average particle size of 0.5 nm, and dispersed by using a dispersing machine (¼G Sand Grinder Mill, Imex Co., Ltd.) for 5 hours to prepare a organic polyhalogenide dispersion.

(Preparation of coating solution for image-forming layer)

100 g of the organic acid silver salt dispersion, 20 g of the reducing agent dispersion, 15 g of the organic polyhalogenide dispersion, 40 g of 49 wt % LACSTAR3307B (Dainippon Ink & Chemicals, Inc., SBR latex, Tg=13° C.), 20 g of 10 wt % aqueous solution of MP-203 (Kuraray Co., Ltd., polyvinyl alcohol), 20 g of silver halide emulsion, 8 ml of 1 wt % methanol solution of 1-formyl-2-(o-methoxyphenyl)-hydrazine, and 100 g of water were sufficiently mixed to form a coating solution for image-forming layer.

The coating solution was applied so as to give a coated silver amount of 1.5 g/m$^2$ and coated polymer latex solid amount of 5.7 g/m$^2$.

(9) Protective layer (Preparation of coating solution for protective layer)

262 g of $H_2O$ was added to 500 g of a 40 wt % polymer latex (copolymer of methyl methacrylate/styrene/2-ethylhexyl acrylate/2-hydroxyethyl methacrylate/methacrylic acid=59/9/26/5/1, Tg; 47° C.), and the mixture was added successively with 14 g of benzyl alcohol as a film forming aid, 2.5 g of Compound-2 described below, 3.6 g of Cellosol 524 (Chukyo Oil and Fat Co., Ltd.), 12 g of Compound-3 described below, 1 g of Compound-4 described below, 2 g of Compound-5 described below, 7.5 g of Compound-6 described below, and 3.4 g of polymethyl methacrylate microparticles having an average particle size of 3 μm as a matting agent, and further added with water to give the total weight of 1000 g of a coating solution having a viscosity of 5 cp (25° C.) and pH=3.4 (25° C).

This coating solution was applied to give 2 g/m$^2$ of the solid content of the polymer latex.

The above-obtained material was used as a comparative sample, and samples according to the present invention were prepared by adding, to the image-forming layer of the above sample, the compounds of the present invention represented by the formula (I) or (II) shown in Table 3 in an amount of $7.0\times10^{-4}$ mol per 1 mol of silver.

Compound-2

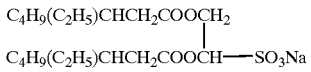

Compound-3

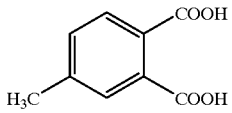

Compound-4

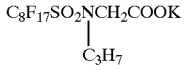

Compound-5

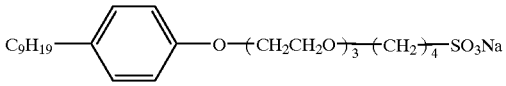

Compound-6

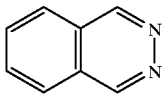

After the coated layers were provided as described above, the samples were dried at 60° C. for 2 minutes to obtain heat-developable image-recording materials.

(Evaluation of photographic performance)

Each of the obtained heat-developable image-recording materials was exposed to a xenon flash light for an emission time of $10^{-6}$ seconds through an interference filter having a peak at 780 nm and a step wedge, and then developed by using the heat-developing apparatus used in Example 1. The maximum density and contrast of the obtained image were evaluated. The results are shown in Table 3. By using the compounds of the present invention, high Dmax and high contrast were obtained.

TABLE 3

| | Compound of the present invention | Development: 120° C., 15 sec | | Development: 120° C., 20 sec | |
|---|---|---|---|---|---|
| | | Dmax | γ | Dmax | γ |
| 1 | Blank* | 3.15 | 7.0 | 3.62 | 10.5 |
| 2 | I-1 | 3.81 | 12.4 | 4.31 | 15.6 |
| 3 | I-5 | 4.03 | 14.1 | 4.47 | 16.1 |
| 4 | I-8 | 3.99 | 13.8 | 4.38 | 15.9 |
| 5 | I-9 | 3.73 | 11.0 | 4.11 | 12.6 |
| 6 | I-10 | 3.60 | 9.2 | 4.03 | 11.9 |
| 7 | I-13 | 3.75 | 11.5 | 4.27 | 13.8 |

*Comparative Example

What is claimed is:

1. A heat-developable image-recording material comprising an organic silver salt, a reducing agent, and an organic binder, wherein the material further comprises a compound represented by the following formula (I) or (II):

(I)

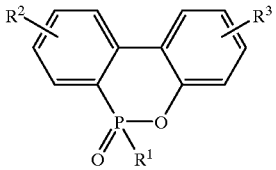

(II)

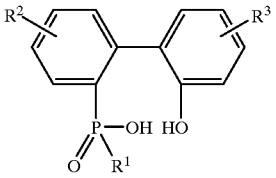

wherein $R^1$ is selected from the group consisting of a hydrogen atom, an alkyl group, an aryl group, a hydroxyl group, an amino group, a thiol group, an alkoxyl group, and a thioether group; and $R^2$ and $R^3$ may be the same or different and represent a hydrogen atom or 1 to 4 functional groups selected from the group consisting of a hydroxyl group, an amino group which may be substituted, an alkyl group having 1 to 30 carbon atoms, a carbonyl group, a carbamoyl group, a thiol group, an alkoxyl group, a thioether group, and a group composed of a repeating unit of ethyleneoxy or propyleneoxy group, a carboxyl group, a cyano group, and a phenyl group.

2. The heat-developable image-recording material according to claim 1, wherein $R^1$ is a hydrogen atom, an alkyl group having 1 to 30 carbon atoms substituted with one or more hydroxyl group, or a phenyl group substituted with one or more hydroxyl group.

3. The heat-developable image-recording material according to claim 1, wherein $R^2$ and $R^3$ are independently a hydrogen atom or an alkyl group having 1 to 30 carbon atoms.

4. The heat-developable image-recording material according to claim 1, which contains photosensitive silver halide grains.

5. The heat-developable image-recording material according to claim 4, which contains a high contrast agent.

6. The heat-developable image-recording material according to claim 4, wherein the compound of formula (I) is added to an image-forming layer containing the photosensitive silver halide grains.

7. The heat-developable image-recording material according to claim 4, wherein the compound of formula (I) is added in an amount of from 1 $[^X]\times10^{-6}$ to 1 $[^X]\times10^{-2}$ mole based on per mole of silver.

8. The heat-developable image-recording material according to claim 7, wherein the compound of formula (I) is added in an amount of from 5 $[^X]\times10^{-6}$ to 5 $[^X]\times10^{-3}$ mole based on per mole of silver.

9. The heat-developable image-recording material according to claim 7, wherein the compound of formula (I) is added in an amount of from 1 $[^X]\times10^{-5}$ to 1 $[^X]\times10^{-3}$ mole based on per mole of silver.

10. The heat-developable image-recording material according to claim 1, further comprising a color-tone adjustor.

11. The heat-developable image-recording material according to claim 10, further comprising a high contrast agent.

12. The heat-developable image-recording material according to claim 1, wherein the aryl group represented by $R^1$ is an unsubstituted or a substituted phenyl group or naphthyl group.

13. The heat-developing image-recording material according to claim 1, wherein $R^1$ is selected from the group consisting of a hydrogen atom, an alkyl group substituted with one or more hydroxyl groups and a phenyl group substituted with one or more hydroxyl groups.

14. The heat-developing image-recording material according to claim 1, wherein the compounds of formula (I) are selected from the group consisting of

I-1

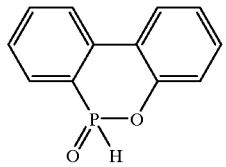

I-2

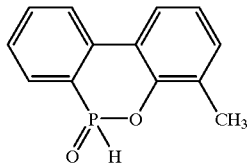

I-3

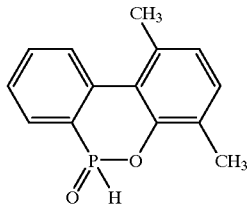

I-4

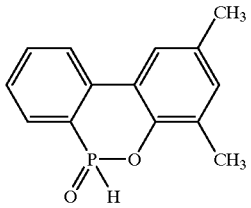

I-5

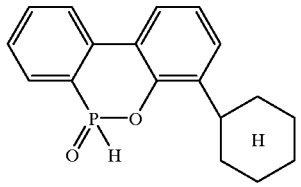

I-6

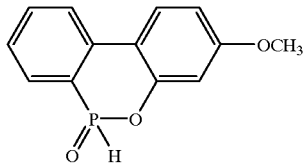

-continued
I-7
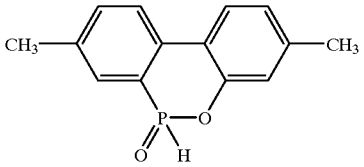
I-8
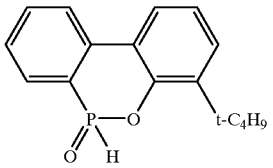
I-9
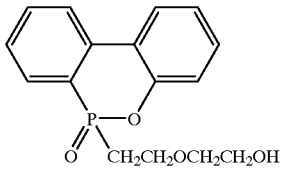
I-10
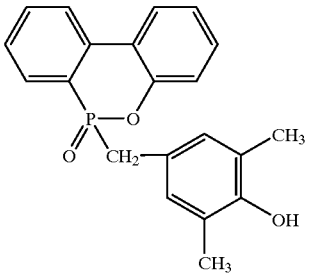
I-11
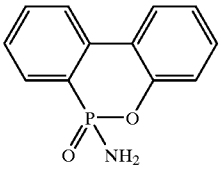
I-12
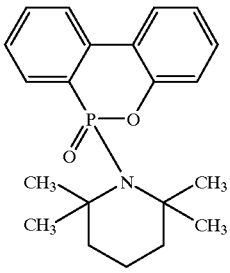
-continued
I-13
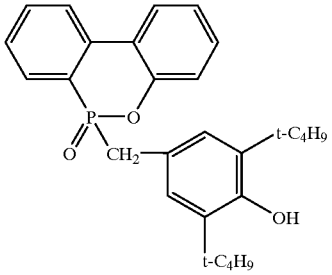
I-14
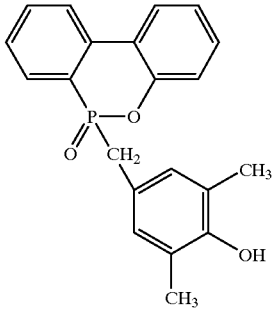
I-15
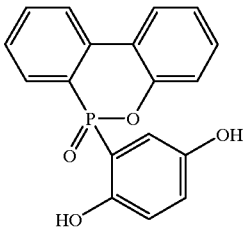
I-16
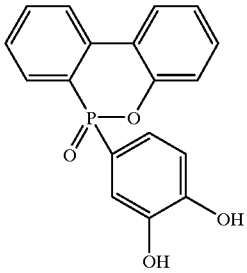
I-17
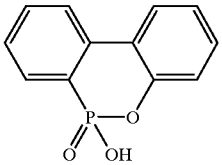

-continued
I-18
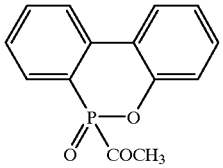
I-19
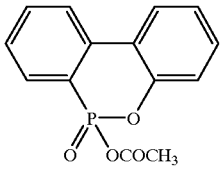
I-20
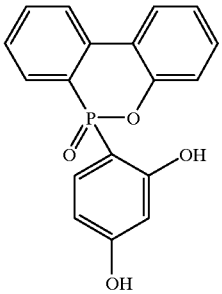
-continued
I-21
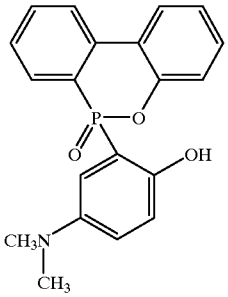
and
I-22
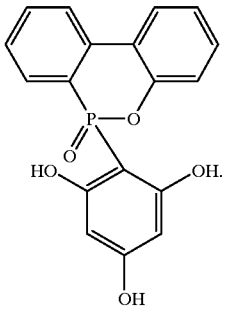
* * * * *